United States Patent [19]

Henderson et al.

[11] Patent Number: 4,836,122

[45] Date of Patent: Jun. 6, 1989

[54] FAIRING SECTIONS

[75] Inventors: James F. Henderson, Bristol; Philip J. Wingham, Bath, both of Great Britain

[73] Assignee: University of Bath, Bath, United Kingdom

[21] Appl. No.: 48,465

[22] Filed: Apr. 27, 1987

Related U.S. Application Data

[63] Continuation of Ser. No. 732,824, May 2, 1985, abandoned.

[30] Foreign Application Priority Data

Sep. 13, 1983 [GB] United Kingdom ..... 8324431

[51] Int. Cl.[4] ..... F15D 1/10

[52] U.S. Cl. ..... 114/243; 114/244

[58] Field of Search ..... 114/242–244, 114/245, 247, 253, 254, 312, 322, 330, 332, 271, 274, 280; 181/110

[56] References Cited

U.S. PATENT DOCUMENTS

| | | | |
|---|---|---|---|
| 3,461,830 | 8/1969 | Pearce | 114/243 |
| 3,467,047 | 9/1969 | Chatten | 114/243 |
| 3,899,991 | 8/1975 | Chatten | 114/243 |
| 3,962,982 | 6/1976 | Marchay | 114/243 |
| 4,200,999 | 5/1980 | Latimer | 114/243 |
| 4,365,574 | 12/1982 | Norminton | 114/243 |
| 4,398,487 | 8/1983 | Ortloff | 114/243 |
| 4,474,129 | 10/1984 | Watkins | 114/243 |
| 4,542,708 | 9/1985 | Holcombe | 114/243 |

*Primary Examiner*—Sherman D. Basinger
*Assistant Examiner*—Clifford T. Bartz
*Attorney, Agent, or Firm*—Young & Thompson

[57] ABSTRACT

A fairing 13 for an element is made up of body sections 17. Each body section 17 comprises a moulded plastics body which has an open recess or hollow 18 along its leading edge 19. The body section 17 becomes slightly wider to the rear of the leading edge 19 and then increasingly rapidly decreases inside along a smooth curve until reaching a trailing portion 20 which thins, at a much slower rate, to edge 21. The mouth of the hollow 18 is defined by lips 23 which are dimensioned to straddle a trailing portion of the cable 12.

In use, the body section 17 automatically aligns along the line of movement of the cable 12 and the body is held against the cable. The arrangement is such that the body sections will compensate for sidewards forces or drags.

16 Claims, 3 Drawing Sheets

FAIRING SECTIONS

This application is a continuation of application Ser. No. 732,824, filed 5/2/85 now abandoned.

This invention relates to fairing sections for underwater elements or the like and in particular, but not exclusively, to electrical towing cables for underwater exploration vehicles.

There is a range of activities, extending from magnesium module mining to sonar surveying, in which it is necessary to tow an object from a ship at a significant depth below the ship. In general the cables used for towing such objects are circular in cross-section and hence there is a considerable drag when they are pulled through the water. The result is that the cable is pulled out into a very flat incline and either a very long cable is needed to achieve a significant depth or it is quite impossible to achieve that depth above a certain towing speed. For this reason there have been a number of proposals for fairings, which can be attached to such cables, to reduce their drag. In general such fairings have been formed as aerofoil sections and commonly they extend right around the cable.

These fairing sections have introduced large number of problems. For example, if any of the sections on the cable is not accurately aligned with the direction of flow then, because of the wing-like shape of the fairing, a significant side force (analogous to the lift on an aircraft wing) is created and the cable is forced sideways with respect to the direction of travel of the ship. Apart from the problems associated with the loss of control of the vehicle at the end of the cable, the most common result is for the cable to be pulled out of the sheave wheel over which it passes at the stern or side of the vessel, causing either significant damage or total loss of equipment. This problem is exacerbated because there is significant friction between the cable and the fairing, which surrounds it, and because the aerofoil sections create the side force very close to the cable axis. Both these factors result in the sections being unable to take up the true direction of flow.

A further problem with existing fairings is that the sections creep along the cable, as it is bent on the storage drum or on the sheave wheel, due to the different circumferential paths taken up by the sections and the cable. This either creates damaging distortion in the fairing sections or rips out the clips by which the sections are attached to the cable.

It is an object of this invention to provide an improved fairing section which overcomes or reduces at least some of these problems.

From one aspect the invention consists in a fairing section for an element comprising a body pivotally mountable on the element and having a leading edge portion formed to straddle a trailing part of the element in use, to provide a flow surface in combination with the element. For the purpose of this specification the term element covers any element or structure which is generally cylindrical in use and is pulled through water or other fluid and/or is positioned in a water or other fluid flow. Thus it covers, inter alia, moorings, oil rig legs, and underwater or air towing cables.

The leading edge portion may be dimensioned to straddle up to the whole of the trailing half of the element, but in a preferred embodiment it straddles approximately a quarter of the trailing portion of the element. Conveniently the leading edge portion includes a pair of spaced projections.

The body may have engagement surfaces for locating the body on the element such that, in the event of the body lying at an angle to the direction of motion of the element, a passage exists between the body and the element through which water can flow. Preferably the inlet and outlet of the passage lie in the region of separated flow created by the element.

The body may define a formation for creating a low pressure area in the hollow between the body and the element, during towing, such that the body and element are held together. In this case the engagement surfaces may constitute the only points of engagement between the element and the body and the engagement surfaces may be conveniently V-shaped in section with curved bearing surfaces.

The body may have a recess for receiving a part of the element when the fairing section is mounted on the element and the element is bent.

The body may be shaped such that the side force induced on the body, when, in use, the body is at an angle to the direction of flow in the water, acts on the downstream most third of the body.

The body may be wider at its leading end than its trailing end and there may be a cusp adjacent the trailing end. Preferably the body is elongate and is symmetrical about a longitudinal plane. For one size of element the body may have a maximum thickness of not more than 25 mm and a minimum thickness of not less than 0.5 mm. For other sizes of element these maxima and minima are preferably proportionately the same.

From another aspect the invention consists in a fairing section for an element comprising a body pivotally mountable on the element, the body defining a formation for creating a low pressure area between the body and the element, in flow conditions, such that the element and body are held together.

In a preferred embodiment the section has a pair of spaced engagement surfaces for engaging the element when the body is held to the element such that there is no other point of engagement between them. Conveniently these surfaces are generally V-shaped in section and may be curved.

From a further aspect the invention consists in a fairing section for an element comprising a body having a recess for receiving a part of the element when the fairing is mounted on the element and the element is bent.

From yet another aspect the invention consists in a fairing section for an element having a body shaped such that the side force induced on the body, when the body is at an angle to the direction of flow of the water, acts on the downstream most third of the body.

In another aspect the invention consists in a fairing section for an element comprising a body mountable on the element to define a passage for water to pass from one side of the body to the other, when, in flow conditions, the body is tilted to the direction of flow; the end openings of the passage being in the region of separated flow created by the element in flow conditions.

The invention also consists in a fairing for an element comprising a plurality of fairing sections as defined above. The fairing sections may be interconnected or formed to articulate about a virtual centre such that the element arc length is substantially equal to the fairing chord length subtended on a bearing surface of predetermined curvature.

The invention may be performed in various ways and one specific embodiment will now be described, by way of example, with reference to the accompanying drawings, in which.

Figure 1:
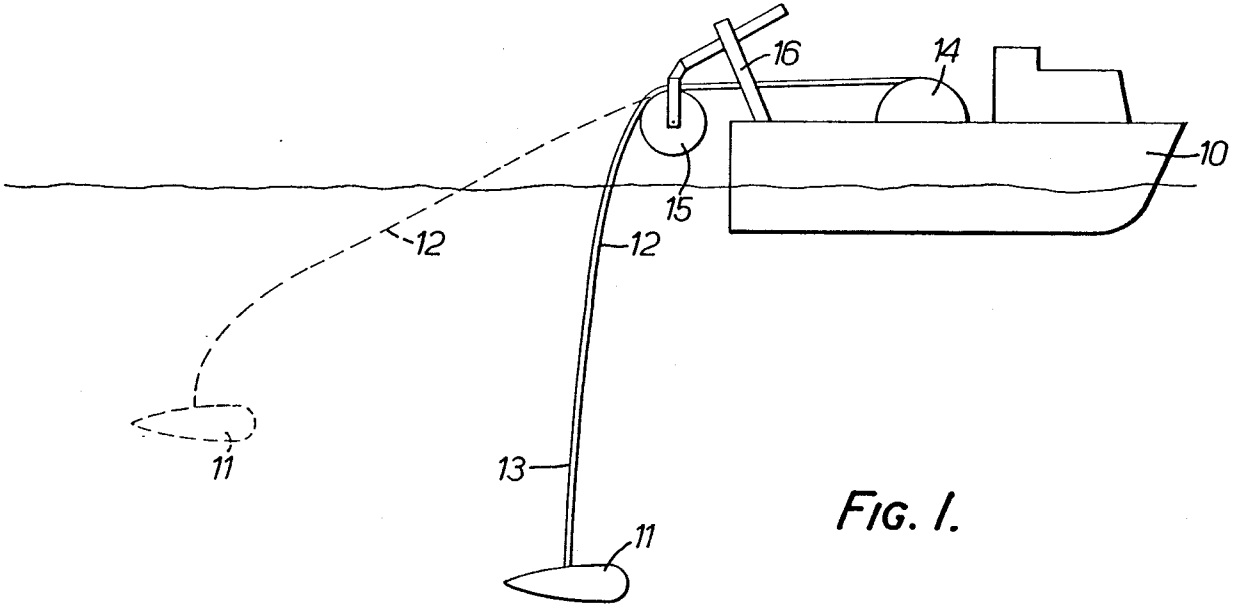
FIG. 1 is a diagrammatic view of a ship towing a surveying device.

FIG. 1 generally illustrates a ship 10 towing a sonar surveying vehicle or "fish" 11 by means of a cable 12. In its dotted line form the cable is entirely unstreamlined and it will be seen that its drag pulls the fish dramatically sternwards of the ship causing a very shallow depth to be achieved. In the solid line form the cable is provided with a fairing 13 and a far greater depth is achieved for the same length of cable.

In each case the cable 12 is fed from a cable drum 14 over a sheave wheel 15, which is suspended to the rear of the stern by means of a crane mounting 16.

Figure 2:
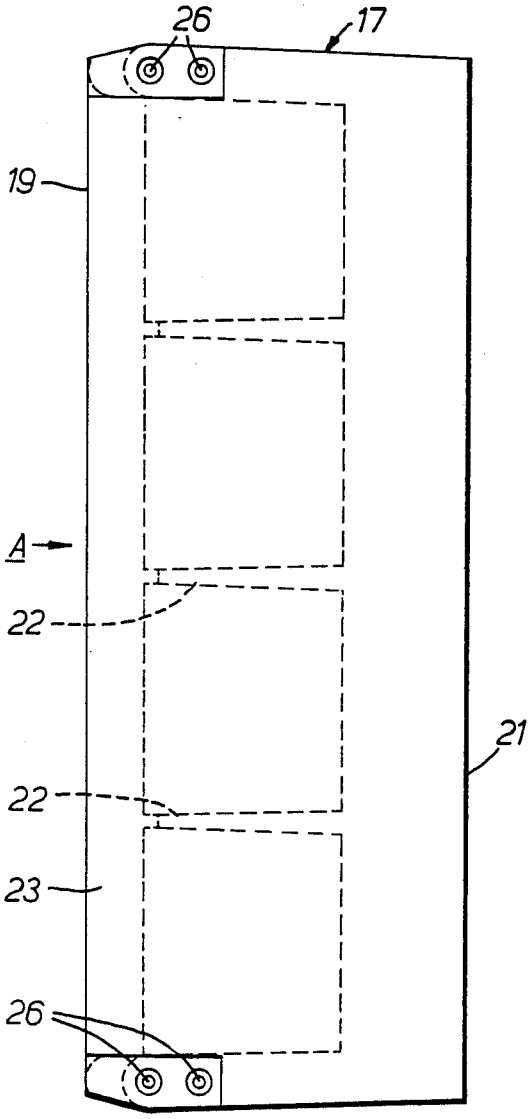
FIG. 2 is a side view of a fairing section for an underwater towing cable.
Figure 3:
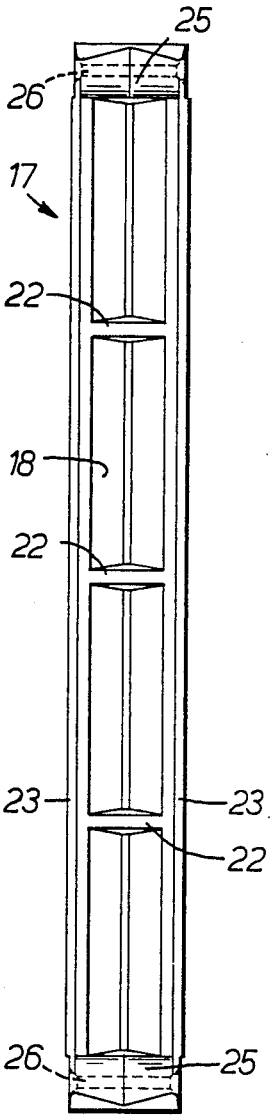
FIG. 3 is an edge view on the arrow A of the section of FIG. 2.
Figure 4:
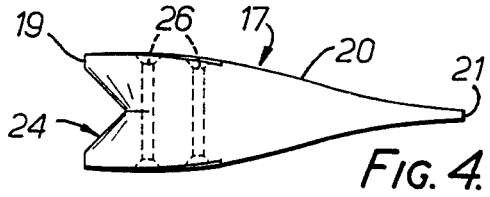
FIG. 4 is an end view of the section of FIG. 2.
Figure 7:
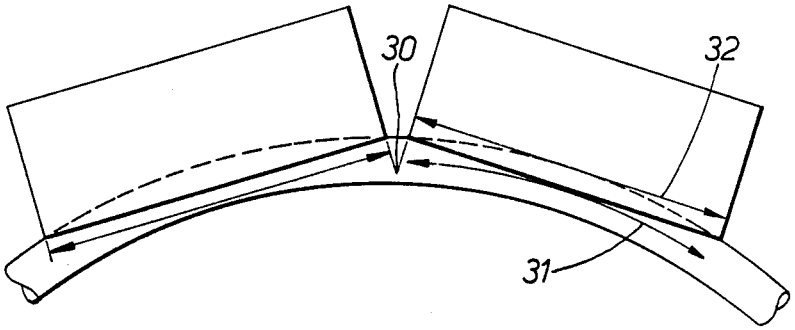
FIG. 7 is a schematic view of two fairing sections articulated together on a cable which is bent.

The fairing 13 is made up of end to end body sections 17, one of which is illustrated in FIGS. 2 to 4. Each body section 17 comprises a moulded plastics body, for example of polypropylene, which has an open recess or hollow 18 along its leading edge 19. In end view (see FIG. 4) the body section becomes slightly wider to the rear of the leading edge 19 and then increasingly rapidly decreases in size along a smooth curve until reaching a trailing portion 20 which thins at a much slower rate until it reaches a trailing edge 21, which for reasons of strength may be squared off.

Figure 5:
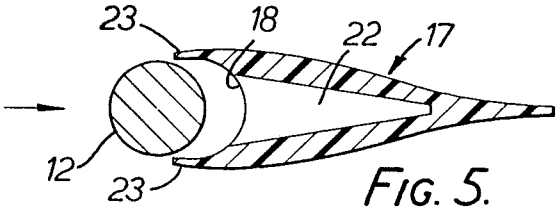
FIG. 5 is a diagrammatic sectional view of the section of FIG. 2 mounted on a cable and streaming in the line of movement of the section in the water.

The recess or hollow extends deep into the thicker section of the body section only interrupted by a number of strengthening ribs 22. Its mouth is defined by a pair of spaced projections or lips 23 which are dimensioned to straddle a trailing portion of the cable 12 (see FIG. 5). The recess 18 is partially closed off at top and bottom to form V-shaped notches 24 which are defined by cable engaging rounded surfaces 25. Screw holes 26 or other means are provided adjacent engagement surfaces 25 for receiving clips (not shown) by means of which the body section is attached to the cable.

Figure 6:
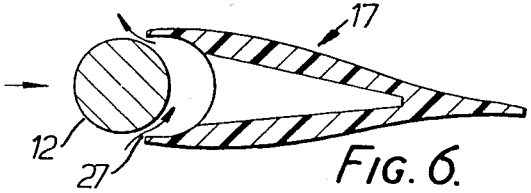
FIG. 6 is the equivalent view to FIG. 5 but with the section at an angle to the line of movement.

In use, the body sections 17 are mounted on the cable by the retaining clips mentioned above so that they can freely pivot on the cable. When the cable is lowered into the water the body sections automatically align along the line of movement of the cable 12. The position of the lips 23 in relation to cable 12 creates an area of low pressure in the recess 18 which causes the leading edge 19 of the body section to be sucked against the cable. Normally this would cause engagement of the body section along its whole length and thus create appreciable friction, but with this construction the only points of contact are the engagement surfaces 25 which hold the body section in the position shown in FIG. 5 with the clips standing proud of the cable. This arrangement not only considerably reduces the friction between the cable 12 and the body section 17, but also ensures that the body section 17 sits in the hydrodynamically most advantageous position. The applicant has established that for a number of reasons this position is that in which the lips 23 straddle the trailing quarter of the cable 12. In fact this is not the position which creates the least drag, but it both provides a very low drag and enables, as will be seen from FIG. 6, a passage to exist between the lips 23 and the cable 12, if the body section 17 should ever lie at an angle to the line of motion. This passage 27 allows water to flow from one side of the body section 17 to the other and has its open ends lying in the region of separated flow created by the cable. This has two major advantages in that it both reduces the side or lift force created by the flow past the angled section and further it moves the point through which that force acts towards the trailing edge 21 of the body section 17. This latter effect is enhanced by the cusp adjacent the trailing end 21 with the result that there is a considerable moment, even with the reduced side force, so that the body section 17 will quickly be returned to its correct streaming position. That is to say that the body section has unusually high "weathercock" stability combined with small lift slope. The construction of the body section 17 not only provides a low drag and low side force section, but also it considerably improves the mechanical handling of the cable/section assembly. This is because as the cable passes over either the drum 14 or the sheave wheel 15 the bending cable can pass into the recess 18 significantly reducing the need for any fairing creep. The extent to which the cable can be allowed to enter the fairing is limited by the ribs 22 in the light of the sheave wheel dimensions, because the lips 23 should not contact the sheave wheel 15.

In order to further reduce creep it has been found that the sections should be articulated with respect to one another about a virtual centre 30 such that the cable arc 31 length is equal to the section chord length 32 subtended on a bearing surface of predetermined curvature i.e. the known surfaces of the drum 14 and sheave wheel 15.

Apart from easing mechanical handling and reducing damage this arrangement allows longer fairing sections to be achieved and hence reduces the total number of clips needed for the whole cable. This further reduces the total drag on the cable and any friction created by the clips.

It will be appreciated that the fairing section described above has many new and improved features and that these may be utilised severally with some advantage. Indeed all the features may not necessarily be desirable in certain uses. It will further be appreciated that the section can be made of any suitable material and by any appropriate method.

The fairing section may be used with any element which has a generally cylindrical cross-section, in use, and which experiences detrimental fluid drag, for example oil rig legs, moorings, pipelines, etc.

I claim:

1. Fairing section comprising a leading edge portion having a pair of forwardly projecting lips and a recess defined between the lips for receiving a part of a cylindrical element so that the lips straddle the element, a trailing edge and a body interconnecting said leading edge portion and said trailing edge; said body comprising a pair of oppositely disposed, continuous surfaces each being initially convex and then concave as they extend from the leading edge portion to the trailing edge such that they approach each other as they approach the trailing edge.

2. Fairing section according to claim 1, wherein said leading edge portion comprises spaced ends and an intermediate portion extending between and interconnecting said spaced ends, said spaced ends having engaging means adapted to engage a cylindrical element and to space said intermediate portion a substantial distance from said cylindrical element to define a flow passage between said fairing section and said cylindrical element intermediate said spaced ends.

3. Fairing section according to claim 1, wherein said body is symmetrical about a plane containing the trailing edge and extending through the leading edge portion.

4. Fairing section according to claim 2, wherein each said engaging means comprises a V-shaped member adapted to bear against a cylindrical element.

5. Fairing section comprising a leading edge portion having spaced forwardly projecting lips, a trailing edge and a body interconnecting said leading edge portion and said trailing edge; said leading edge portion comprising two spaced ends and an intermediate portion interconnecting the spaced ends, each spaced end having at least one V-shaped engagement member for engaging a cylindrical element to space said intermediate portion a substantial distance from said cylindrical element thereby to define a flow passage between said fairing section and said cylindrical element, intermediate opposite ends and to hold the lips so that they straddle a part of the cylindrical element.

6. Fairing section according to claim 5, wherein said body comprises a pair of oppositely disposed continuous surfaces each being initially convex and then concave as they extend towards the trailing edge so that they approach each other as they approach the trailing edge.

7. Fairing section according to claim 6, wherein said body is symmetrical relative to a plane containing said trailing edge and extending through said leading edge portion.

8. In an apparatus comprising a generally cylindrical element for being pulled through a fluid or for being subjected to fluid flow, a fairing section comprising a body and means for pivotally mounting the body on the element to the rear of the element, the body having a leading elongate edge portion that terminates forwardly in a pair of forwardly directed spaced lips having forwardly directed free edges, said lips extending lengthwise on the leading edge portion and defining a substantially concave recess between the lips for receiving a trailing part of the element so that the lips straddle the trailing part of the element, and engagement means for locating the body on the element to space the leading edge portion, and hence the lips, from the element to define a passage between the element and the leading edge portion extending from one lip through the recess to the other lip at least when the body lies at an angle to the direction of flow, so that fluid can flow through the passage.

9. A fairing section as claimed in claim 8, wherein the leading edge portion is dimensioned so that the lips straddle up to the whole of the trailing half of the element.

10. A fairing section as claimed in claim 9, wherein the leading edge portion is dimensioned so that the lips straddle at least a quarter of the trailing portion of the element.

11. A fairing section as claimed in claim 8, wherein the engagement means are defined by a pair of projections located adjacent to the ends of the leading edge portion.

12. In an apparatus comprising a generally cylindrical element for being pulled through a fluid or for being subjected to fluid flow, a fairing section comprising a body having a leading edge portion that terminates forwardly in a pair of forwardly directed spaced lips having forwardly directed free edges, means for mounting the body on the element to the rear of the element such that the lips straddle the element to define with the element an inner space along the portion with openings to the space between the lips and the element, the means for mounting further retaining the openings in an area of low pressure in the flow to communicate that low pressure to the space and thereby hold the body against the element.

13. A fairing section as claimed in claim 12, wherein the mounting means includes spaced engagement means formed on the body for engaging the body to the element when the body is held to the element such that there is no other point of contact between the element and the body.

14. A fairing section as claimed in claim 13, wherein the engagement means are generally V-shaped.

15. A fairing section as claimed in claim 13, wherein the engagement means have rounded contact surfaces.

16. A fairing section as claimed in claim 13, wherein the leading edge portion is dimensioned such that the lips straddle between one half and one quarter of the element.

* * * * *